US010570552B2

(12) United States Patent
Haberlander et al.

(10) Patent No.: US 10,570,552 B2
(45) Date of Patent: Feb. 25, 2020

(54) LAUNDRY-CARE APPLIANCE COMPRISING A METERING SYSTEM

(71) Applicant: BSH HAUSGERÄTE GMBH, München (DE)

(72) Inventors: Bernd Haberlander, Oberhaching (DE); Hans Eglmeier, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 179 days.

(21) Appl. No.: 15/567,188

(22) PCT Filed: Mar. 23, 2016

(86) PCT No.: PCT/EP2016/056406
§ 371 (c)(1),
(2) Date: Oct. 17, 2017

(87) PCT Pub. No.: WO2016/169721
PCT Pub. Date: Oct. 27, 2016

(65) Prior Publication Data

US 2018/0135228 A1 May 17, 2018

(30) Foreign Application Priority Data

Apr. 22, 2015 (DE) ..... 10 2015 207 342

(51) Int. Cl.
*D06F 39/02* (2006.01)
*F04C 11/00* (2006.01)
(Continued)

(52) U.S. Cl.
CPC ..... *D06F 39/028* (2013.01); *D06F 39/022* (2013.01); *F04C 11/001* (2013.01);
(Continued)

(58) Field of Classification Search
CPC combination set(s) only.
See application file for complete search history.

(56) References Cited

U.S. PATENT DOCUMENTS

2006/0157086 A1* 7/2006 Kappler ..... A47L 15/4257 134/34
2010/0115709 A1* 5/2010 Kim ..... D06F 39/022 8/159
(Continued)

FOREIGN PATENT DOCUMENTS

CN 103225196 A 7/2013
DE 1 528 964 6/1969
(Continued)

OTHER PUBLICATIONS

International Search Report for PCT/EP2016/056406, dated May 24, 2016, 6 pages.
(Continued)

*Primary Examiner* — Cristi J Tate-Sims
(74) *Attorney, Agent, or Firm* — Nixon & Vanderhye P.C.

(57) ABSTRACT

The present invention relates to a laundry-care appliance (100) comprising a metering system (105) for metering a first liquid substance and a second liquid substance, wherein the metering system (105) comprises a first storage container (107) for providing the first liquid substance, a second storage container (109) for providing the second liquid substance, and a pump unit (112) which comprises a first pump head (113) and a second pump head (115). The metering system (105) comprises a common drive (129) for driving the first pump head (113) and the second pump head (115), wherein the common drive (129) can be driven in a first drive direction (137) and in a second drive direction (139). The first pump head (113) is designed in the case of the first drive direction (137) of the common drive (129) to convey the first liquid substance in a first conveying direction (149) from the first storage container (107). The second pump head (115) is designed in the case of the second drive direction (139) of the common drive (129) to convey the
(Continued)

second liquid substance in a second conveyor direction (153) from the second storage container (109).

18 Claims, 6 Drawing Sheets

(51) Int. Cl.

| | |
|---|---|
| ***F04C 14/04*** | (2006.01) |
| *F04C 2/02* | (2006.01) |
| *F04C 2/16* | (2006.01) |
| *F04C 2/34* | (2006.01) |

(52) U.S. Cl.
CPC ..... *F04C 14/04* (2013.01); *F04C 2/025* (2013.01); *F04C 2/16* (2013.01); *F04C 2/34* (2013.01)

(56) References Cited

U.S. PATENT DOCUMENTS

| | | | |
|---|---|---|---|
| 2011/0033318 A1 | 2/2011 | Ramirez, Jr. et al. | |
| 2016/0258106 A1* | 9/2016 | Kim | D06F 39/022 |

FOREIGN PATENT DOCUMENTS

| | | |
|---|---|---|
| DE | 102 12 184 | 10/2003 |
| DE | 10 2006 012283 | 3/2007 |
| KR | 10-2013-0022792 A | 3/2013 |

OTHER PUBLICATIONS

International Preliminary Report on Patentability for PCT/EP2016/056406, dated Jun. 8, 2017, 28 pages.
English translation of Amended Sheets of the International Preliminary Report on Patentability for PCT/EP2016/056406, 6 pages.

* cited by examiner

LAUNDRY-CARE APPLIANCE COMPRISING A METERING SYSTEM

This application is the U.S. national phase of International Application No. PCT/EP2016/056406 filed 23 Mar. 2016, which designated the U.S. and claims priority to DE Patent Application No. 10 2015 207 342.4 filed 22 Apr. 2015, the entire contents of each of which are hereby incorporated by reference.

The present invention relates to a laundry care appliance with a metering system.

In order to ensure that laundry is treated effectively in a conventional laundry care appliance, a quantity of a liquid substance is dispensed to the laundry in the laundry drum. So that the user of the laundry care appliance does not have to dispense the liquid substance manually into the soap tray of the laundry care appliance, laundry care appliances can have metering systems, which can ensure the automatic dispensing of liquid substance.

In DE 1 528 964 a dispenser apparatus for washing machines or dishwashers is described, which comprises a peristaltic pump.

It is the object of the invention to provide a laundry care appliance with an effective metering system.

Said object is achieved by subject matter having the features as set out in the independent claim. Advantageous embodiments of the invention are set out in the drawings, description and dependent claims.

According to one aspect of the invention the object is achieved by a laundry care appliance with a metering system for metering a first liquid substance and a second liquid substance, the metering system comprising a first storage container for supplying the first liquid substance, a second storage container for supplying the second liquid substance, and a pump facility with a first pump head and a second pump head, the metering system comprising a common drive for driving the first pump head and the second pump head, the common drive being able to be driven in a first drive direction and a second drive direction, the first pump head being configured in the first drive direction of the common drive to convey the first liquid substance from the first storage container in a first conveying direction and the second pump head being configured in the second drive direction of the common drive to convey the second liquid substance from the second storage container in a second conveying direction.

This has the technical advantage that the inventive metering system allows effective metering of liquid substance from the first or second storage container by means of just one common drive. In conventional multiple duct metering systems one pump with a pump head is generally used for each duct, being operated in each instance using a separate drive motor, drive transmission and a coupling element.

In the present invention an economical, compact metering system for two ducts is specified, the metering system comprising the common drive incorporated in the laundry care appliance and the metering facility which is preferably to be removed from the laundry care appliance. The metering facility in turn comprises the pump facility with the first pump head and the second pump head. The conveying direction of the pump facility, which comprises a reversible first pump head and a reversible second pump head, can advantageously be changed by changing the drive direction of the common drive. The two pump heads are connected mechanically in a parallel manner, in other words with a single common drive. However the two pump heads can be connected hydraulically in an antiparallel manner, in other words when the pump facility is driven in the first drive direction, the first pump head operates with suction on the connected first storage container, with metering taking place from the first storage container. The second pump head in contrast does not operate with suction on the second storage container in the first drive direction, instead running dry for example.

When the drive direction is changed to the second drive direction of the common drive, the second pump head operates with suction on the connected second storage container, with metering taking place from the second storage container. The first pump head in contrast does not operate with suction on the first storage container in the second drive direction, instead running dry for example.

A laundry care appliance refers to an appliance, which is used to treat laundry, for example a washing machine or tumble dryer. In particular such a laundry care appliance refers to a domestic laundry care appliance, in other words a laundry care appliance used in a domestic situation to treat laundry in normal domestic quantities.

In one advantageous embodiment of the laundry care appliance the first pump head and the second pump head are connected hydraulically in an antiparallel manner, the first conveying direction corresponding to the first drive direction and the second conveying direction corresponding to the second drive direction.

This has the technical advantage that the antiparallel hydraulic connection of the first pump head and the second pump head allows effective metering of just one liquid substance from one of the storage containers. The common drive can operate the first pump head and the second pump head mechanically in a parallel manner so that the first drive direction corresponds to the first conveying direction and the second drive direction corresponds to the second conveying direction. The hydraulic antiparallel connection of the first pump head and the second pump head means that it is only possible to meter from one of the storage containers in one drive direction.

In one advantageous embodiment of the laundry care appliance the first pump head and the second pump head are connected hydraulically in a parallel manner, the metering system comprising a reversing transmission for a drive direction change, which is connected between the common drive and the second pump head, it being possible for the first pump head to be operated in the first conveying direction in the first drive direction of the common drive and for the second pump head to be operated in the second conveying direction in the second drive direction of the common drive.

This has the technical advantage that the use of a reversing transmission means that the same pump heads can be used for both ducts. The first pump head and the second pump head can be connected hydraulically in a parallel manner. The connection between the first pump head and the first storage container and the second pump head and the second storage container is in the same hydraulic direction. The reversing transmission connected between the common drive and the second pump head can perform a drive direction change. As a result the first pump head can be operated in the first conveying direction in the first drive direction of the common drive and metering can take place from the first storage container. In the second drive direction of the common drive the second pump head can be operated in the second conveying direction and metering can take place from the second storage container. The use of the reversing transmission means that it is only possible to meter from one of the storage containers in one drive direction of the common drive when the first pump head and the second pump head are connected hydraulically in a parallel manner.

In one advantageous embodiment of the laundry care appliance the common drive comprises a drive motor, the drive motor being configured to drive the first pump head and the second pump head and the drive motor in particular comprising an electric motor.

This has the technical advantage that the drive motor ensures effective driving of the first pump head and the second pump head. The drive motor can comprise in particular an electric motor, for example a BLDC motor, its drive direction being able to be switched electrically. The drive motor is part of the common drive of the metering system and is brought into contact with the pump facility of the metering system so that the drive motor can drive the pump facility effectively. A suitable coupling connected downstream of the drive motor allows a link to be established between the drive direction of the drive motor and the conveying direction of the first or second pump head. This allows effective metering of liquid substance from the first or second storage container with just one drive motor.

In one advantageous embodiment of the laundry care appliance the common drive comprises a drive transmission, the drive transmission being configured to transfer a torque of the drive motor, and the metering system comprises a coupling element, the coupling element being configured to couple the drive transmission mechanically to the first pump head and the second pump head.

This has the technical advantage that the drive transmission allows effective transfer of the torque of the drive motor. The drive motor and drive transmission are part of the common drive of the metering system. The coupling element allows the drive transmission to be coupled to the pump facility of the metering system. This allows an effective link to be achieved between the drive transmission and the pump facility.

In one advantageous embodiment of the laundry care appliance the drive transmission comprises a worm shaft.

This has the technical advantage that the configuration of the drive transmission as a worm shaft allows the torque to be transmitted particularly effectively from the drive motor to the pump facility. In the case of a worm shaft with just a right- or left-hand thread, two drive wheels positioned next to one another on the same side of the worm shaft co-rotate provided the pump heads point in the same direction. In order to achieve a pump direction that is rotation direction selective, the two pump heads have to be symmetrical to one another, in other words two different pump heads are present. Two variants can be used in order to be able to utilize identical pump heads with this configuration with drive wheels positioned on the same side of the worm shaft and a rotation direction selective pump action. In the first variant a simple worm shaft with just a right- or left-hand thread is used, the counter rotation of the pump heads being made possible by drive wheels on different sides of the worm. In the second variant a worm shaft divided into zones is used, the worm shaft having a left-hand thread in the first zone and a right-hand thread in the second zone or a right-hand thread in the first zone and a left-hand thread in the second zone. In the second variant the first pump head and the second pump head are arranged next to one another on the same side of the worm shaft and the first pump head and the second pump head can thus be configured identically, which is advantageous in respect of the simple configuration and production costs of the pump facility.

In one advantageous embodiment of the laundry care appliance the first pump head is configured to pump the first liquid substance with a first volumetric flow rate and the second pump head is configured to pump the second liquid substance with a second volumetric flow rate, the first and second volumetric flow rates being a function of viscosity and the first volumetric flow rate and the second volumetric flow rate being greater than the volumetric flow rate when pumping air.

This has the technical advantage that the viscosity selective volumetric flow rate of the pump facility prevents air passing into the storage containers.

If pump heads comprise non-elastic parts, leak points can occur. When conveying fluids, for example liquid substances, the fluid is continuously pressed back through the leak points in the pump heads during pumping due to the back pressure generated at the outlets of the pump heads during pumping, thereby reducing pump performance correspondingly. As viscous liquid substances with a high viscosity are used in laundry care appliances, the pressure that can be generated as the viscous liquid substances are conveyed is sufficient to allow effective pumping of the liquid substance from the storage containers.

The viscosity of the air taken in is however several degrees lower than the viscosity of the viscous liquid substances. As air is pumped through the pump heads, the pressure that can be generated as air is conveyed is not sufficient to feed air to the storage containers, the pump running dry without conveying anything. This is particularly advantageous for oxygen-sensitive liquid substances or to counteract the drying-out of the liquid substances in the storage containers.

In one advantageous embodiment of the laundry care appliance the pump facility comprises a non-return valve or float valve to reduce a return flow of liquid from the first storage container or second storage container.

This has the technical advantage that the non-return valve can ensure hydraulic rectification of the pump facility. The pump conveys fluid or air depending on rotation direction. A float valve can distinguish between these two media due to the density difference, also referred to as buoyancy. In the case of fluid, the valve closing body floats and opens up the line; in the case of air it sinks and blocks the line. Thus with a float valve the action direction and switching direction are identical to the non-return valve. In contrast to the non-return valve a float valve would allow the level in the pump head to drop back to tank level after metering. Specific leak points are required in the pump heads for pump facilities with valves. Also the non-return valve or float valve can reduce the return flow from the first or second storage container when the pump facility is deactivated and the pressure drops in the first or second substance line. In particular the non-return valve or float valve is positioned on the first or second substance line and is configured such that when the pump heads move back the first and second substance lines are closed to reduce the return flow of liquid substance in the substance line.

In one advantageous embodiment of the laundry care appliance the metering system comprises a first dispenser element for dispensing the first liquid substance to the laundry care appliance from the first storage container and the metering system comprises a second dispenser element for dispensing the second liquid substance to the laundry care appliance from the second storage container, the first dispenser element being arranged above the first storage container and the second dispenser element being arranged above the second storage container.

This has the technical advantage that the first or second dispenser element is always arranged higher than the liquid level of the liquid substance in the storage containers. This prevents an uncontrolled return flow of liquid substance from the first or second storage container when the first and second pump heads are deactivated. Such an arrangement is advantageous in particular when leak points occur in the first pump head and in the second pump head as it prevents the storage containers running out in an unwanted manner.

In one advantageous embodiment of the laundry care appliance the first pump head and the second pump head comprise a rotary piston pump, for example a gear wheel pump, an eccentric screw pump, a scroll compressor or rotary vane pump, or a diagonal flow pump or a hose pump, and in particular an eccentric screw pump.

This has the technical advantage that said pump heads allow effective pumping of liquid substance from the first and second storage containers. Pump heads with few moving parts and of compact and space-saving design that can be integrated advantageously in the metering system are preferred.

In one advantageous embodiment of the laundry care appliance the first pump head or the second pump head is configured respectively as an eccentric screw pump, the respective eccentric screw pump comprising a rotor element and a stator and the rotor element being supported so that it can rotate in the stator.

This has the technical advantage that the use of an eccentric screw pump is particularly advantageous, as eccentric screw pumps are simple and economical to manufacture. An eccentric screw pump comprises a rotating part, the rotor element, and a fixed part, the stator, in which the rotor element moves in a rotating manner.

In one advantageous embodiment of the laundry care appliance the first pump head or the second pump head is configured respectively as a submersible pump.

This has the technical advantage that the submersible pump allows effective pumping of liquid substance from the first and second storage containers.

In one advantageous embodiment of the laundry care appliance the first pump head is connected to the first storage container by a first substance line, the second pump head is connected to the second storage container by a second substance line, the first and second pump heads forming a hose pump, the hose pump comprising a rotor with at least two pressure rollers, at least one pressure roller being in contact with the first substance line and at least one pressure roller being in contact with the second substance line.

This has the technical advantage that the hose pump ensures effective pumping of liquid substance or air through the substance lines. A hose pump comprises a rotor with pressure rollers which are in contact with the substance lines. The pressure rollers here press against the substance lines, thereby deforming the substance lines and bringing about a clamp point, which moves along the substance lines pushing the liquid substance or air forward in the substance lines. The first and second pump heads form the hose pump. This is achieved in that the first substance line passes along one side of the rotor and the second substance line passes along the other side of the rotor. At least one pressure roller of the rotor is in contact with one of the substance lines respectively, so that there is always a clamp point present in the first and second substance lines, thereby preventing liquid substance flowing back in the substance lines. When the rotor moves in a circular manner, the clamp point in the first substance line and the clamp point in the second substance line are moved in different directions by the one pressure roller respectively so that liquid substance or air is conveyed in opposing conveying directions through the first and second substance lines. By switching the rotation direction of the rotor it is possible to change the conveying direction in the first and second substance lines. The rotor preferably comprises three, four or five pressure rollers.

In one advantageous embodiment of the laundry care appliance the laundry care appliance comprises at least one fill level sensor for detecting a fill level of the first liquid substance in the first storage container and for detecting a fill level of the second liquid substance in the second storage container.

This has the technical advantage that the fill level sensor ensures effective detection of the fill levels of the liquid substances in the storage containers. In particular the fill level sensor is arranged on the laundry care appliance and configured to detect liquid substance exiting from the metering system, for example by means of a light barrier. For a known rising pipe cross section with a known relationship between total rotation angle and conveyed volume the first and second pump heads pump a quantity that is proportional to the total rotation angle, in particular proportionally, in other words volume to height. The pump head pumps a quantity that is proportional to the total rotation angle. When the pump facility starts up, the rising pipe fills up first. It is possible to work out the start level in the rising pipe from the known rising pipe cross section, in other words its cross section as a function of rising height, and the rotation angle up to the fluid appearing at the outlet. If the rotation angle of the pump head is proportional to time, a constant rotation speed of the pump being preferred, or the profile of the rotation angle over time is known, it is possible to infer the start level in the rising pipe from a time measurement. As the levels in the rising pipe or in the pump heads equalize some time after the last metering operation due to the leak points in the pump heads, it is therefore possible to infer the level in the storage container after the level equalization time. By detecting the time interval between the start of pump operation and the start of the liquid substance exiting from the metering system it is thus possible to work out the fill level of the liquid substance in the first or second storage container.

In one advantageous embodiment of the laundry care appliance the laundry care appliance comprises a shaft with a detergent tray and the metering system comprises a metering facility, the detergent tray being configured to hold the metering facility.

This has the technical advantage that the detergent tray ensures effective accommodation of the metering facility by the laundry care appliance.

Further exemplary embodiments of the invention are illustrated in the drawings and are described in more detail in the following.

Figure 1:
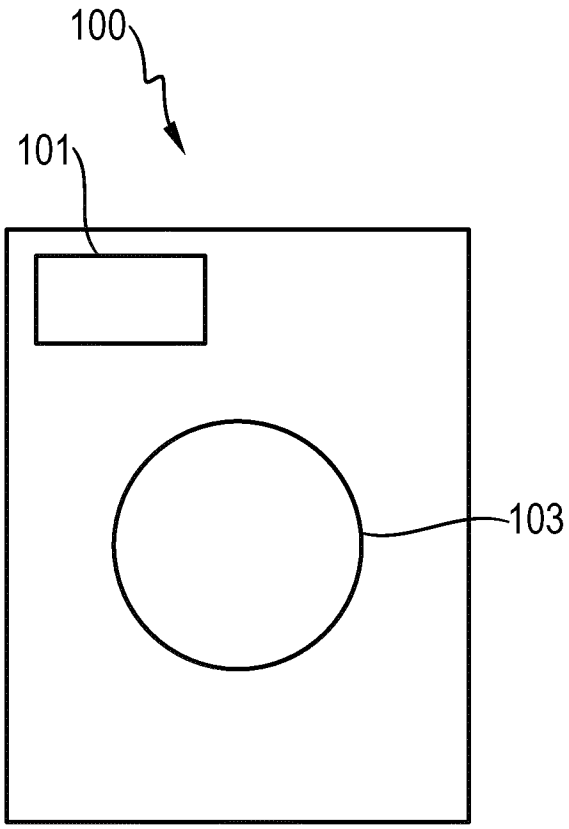
FIG. 1 shows a schematic diagram of a laundry care appliance.

FIG. 1 shows a schematic view of a washing machine representing a general laundry care appliance 100. The laundry care appliance 100 comprises a shaft 101 with a detergent tray, into which detergent or other liquid substances can be introduced. The laundry care appliance 100 comprises a door 103 for loading the laundry care appliance 100 with laundry.

Figure 2:
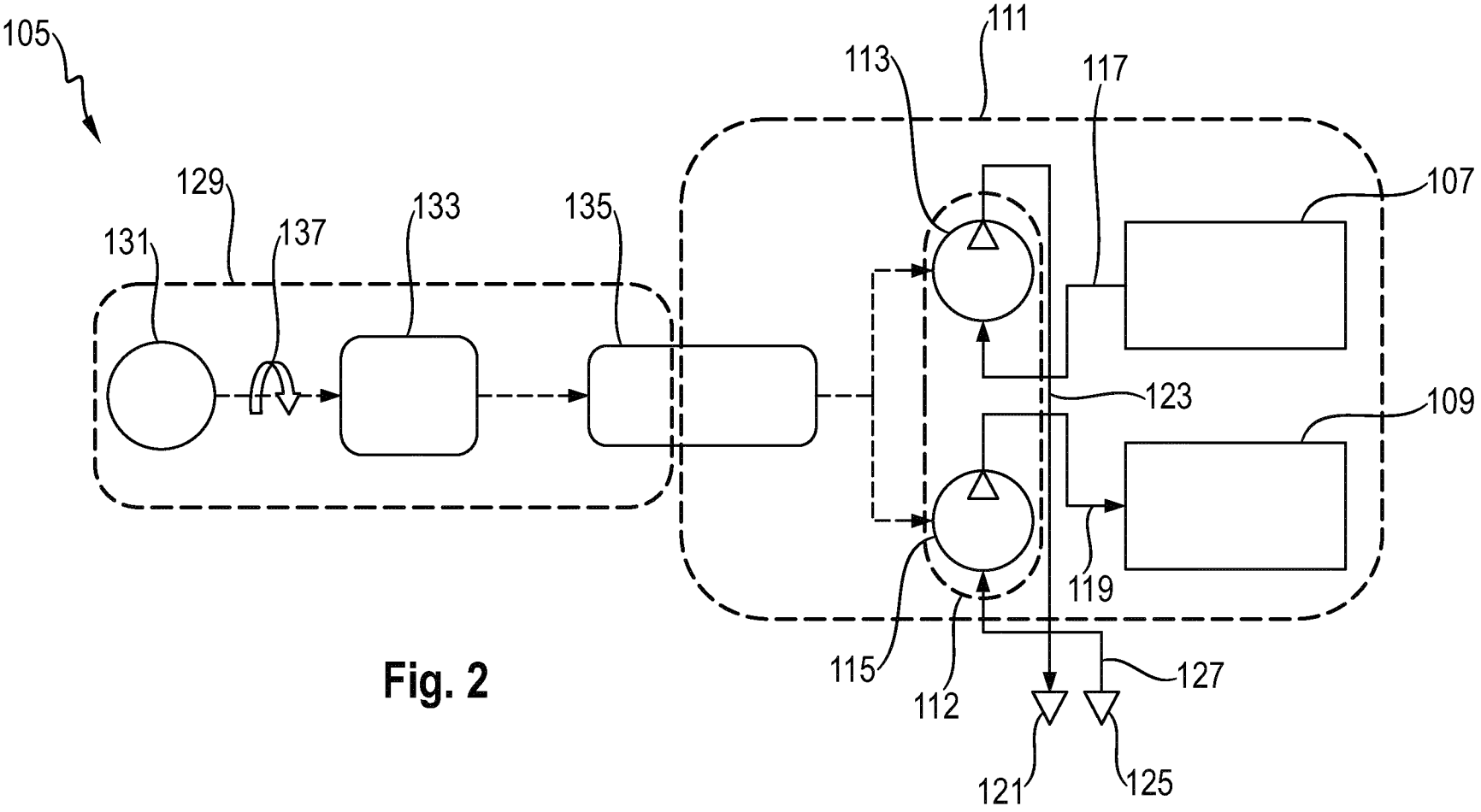
FIG. 2 shows a schematic diagram of a metering system.

FIG. 2 shows a schematic diagram of a metering system. The metering system 105 comprises a metering facility 111 with a first storage container 107 for supplying a first liquid substance and a second storage container 109 for supplying a second liquid substance. The first and second liquid substances can be selected from the group consisting of cleaning agent, detergent, disinfectant, fabric conditioner and bleach. The metering facility 111 is inserted into the shaft 101 of the laundry care appliance 100 in the detergent tray.

The metering facility 111 further comprises a pump facility 112 with a first pump head 113 and a second pump head 115. The first pump head 113 is connected to the first storage container 107 by a first substance line 117. The second pump head 115 is connected to the second storage container 109 by a second substance line 119. The first pump head 113 is connected to a first dispenser element 121 by a first dispenser line 123. The second pump head 115 is connected to a second dispenser element 125 by a second dispenser line 127.

The metering system 105 further comprises a common drive 129, which comprises a drive motor 131 and a drive transmission 133. The metering system 105 further comprises a coupling element 135, which is arranged between the common drive 129 and the metering facility 111 and which is configured to connect the common drive 129 mechanically to the metering facility 111.

In the present instance the drive motor 131 of the common drive 129 moves in a first drive direction 137, the torque being transferred to the pump facility 112 of the metering facility 111 by the drive transmission 133 and the coupling element 135, with the result that the first pump head 113 and the second pump head 115 are moved in a first conveying direction.

In the first conveying direction the first pump head 113 pumps the first liquid substance from the first storage container 107 through the first substance line 117 and through the first dispenser line 123 to the first dispenser element 121. When the metering facility 111 is located in the detergent tray of the laundry care appliance 100, this allows the first liquid substance to be dispensed to the laundry care appliance 100.

In the first conveying direction the second pump head 115 takes in air through the second dispenser element 125 and through the second dispenser line 127 and feeds the air to the second storage container 109 through the second substance line 119 for example or the second pump head 115 runs dry. The air can be introduced into the second liquid substance in the second storage container 109.

Figure 3:
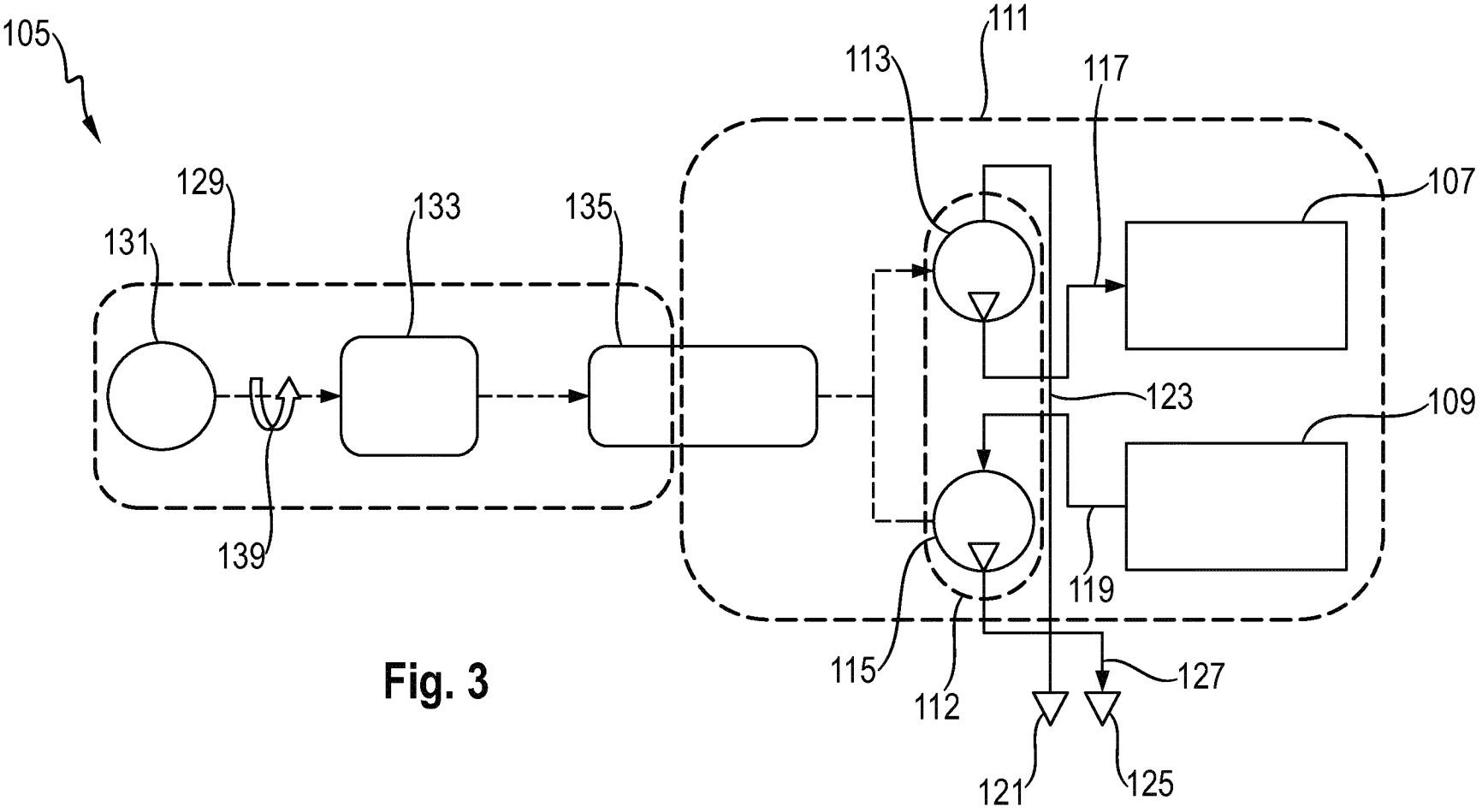
FIG. 3 shows a schematic diagram of a metering system.

FIG. 3 shows a schematic diagram of a metering system according to FIG. 2. The metering system 105 comprises a metering facility 111 with a first storage container 107, a second storage container 109 and lines, as well as a pump facility 112 with a first pump head 113 and a second pump head 115 according to FIG. 2. The metering system 105 comprises a common drive 129 according to FIG. 2.

In the present instance the drive motor 131 of the common drive 129 moves in a second drive direction 139, the torque being transferred to the pump facility 112 by the drive transmission 133 and the coupling element 135, with the result that the first pump head 113 and the second pump head 1115 are moved in a second conveying direction.

In the second conveying direction the first pump head 113 takes in air through the first dispenser element 121 and through the first dispenser line 123 and feeds the air to the first storage container 107 through the first substance line 117 for example or the first pump head 113 runs dry. In the second conveying direction the second pump head 115 pumps the second liquid substance from the second storage container 109 through the second substance line 119 and through the second dispenser line 127 to the second dispenser element 125. When the metering facility 111 is located in the detergent tray of the laundry care appliance 100, this allows the second liquid substance to be dispensed to the laundry care appliance 100.

The drive direction 137, 139 of the drive motor 131, for example electric motor, such as a BLDC motor, can easily be switched electrically, which also changes the conveying direction of the pump facility 112. The first pump head 113 and the second pump head 115 are connected mechanically in a parallel manner, in other words they are driven by a single common drive 129. The first and second pump heads 113, 115 are connected hydraulically in an antiparallel manner. In one conveying direction a pump head 113, 115 operates with suction on the connected storage container 107, 109, with metering taking place from this storage container 107, 109. The other pump head 113, 115 operates at the same time in the opposing direction, in other words air is taken in from the outer region of the laundry care appliance 100 or the other pump head 113, 115 runs dry. By implementing appropriate mechanical or hydraulic equalization downstream of the common drive 129 the pump facility 112 can be used selectively for metering with just one motor.

In order to avoid introducing air into the storage containers 107, 109, as an alternative leak points in the first pump head 113 and the second pump head 115 can advantageously be utilized. The use of non-elastic parts in conventional pump facilities 112 means that minimal leak points occur, the fluid being continuously pressed back through the leak points in the pump during pumping due to the back pressure generated at the outlet of the pump during pumping, and pump performance being correspondingly reduced. As viscous liquid substances with a high viscosity are used in laundry care appliances 100, the pressure that can be generated as the viscous liquid substances are conveyed is sufficient to allow effective pumping of the liquid substance from the storage containers 107, 109.

The viscosity of the air taken in is however several degrees lower than the viscosity of the viscous liquid substances. As air is pumped through the pump facility 112, the pressure that can be generated as air is conveyed is not sufficient to feed air to the storage containers 107, 109, the pump running dry without conveying anything. This is particularly advantageous for oxygen-sensitive liquid substances or to counteract the drying-out of the liquid substances in the storage containers 107, 109.

When pump facilities 112 with minimal leak points are used, the first or second dispenser element 121, 125 can be arranged above the first or second storage container 107, 109, to prevent the storage containers 107, 109 running out in an unwanted manner when the pressure drops.

Figure 4:
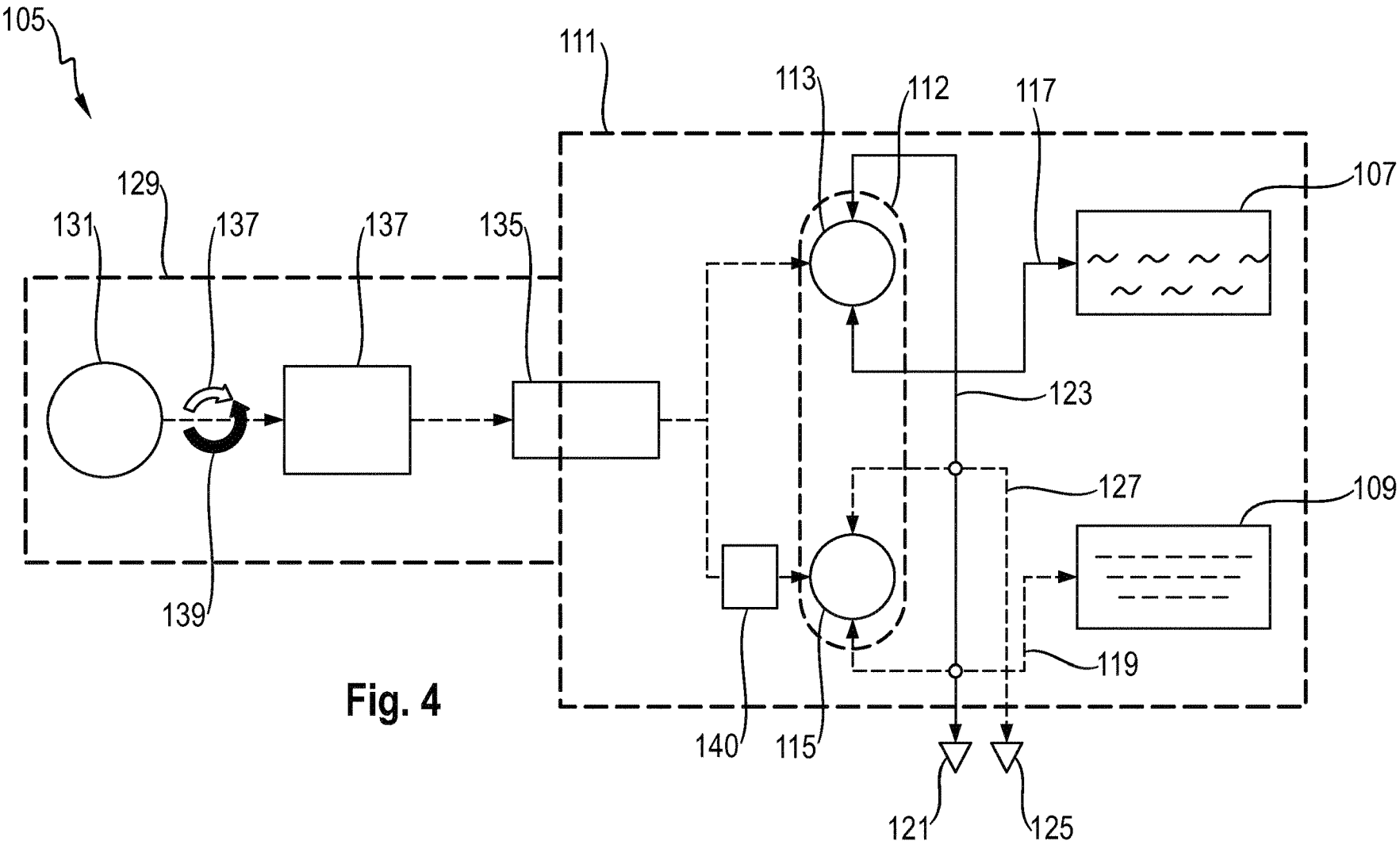
FIG. 4 shows a schematic diagram of a metering system with reversing transmission.

FIG. 4 shows a schematic diagram of a metering system according to FIG. 2 or FIG. 3 with a reversing transmission. The metering system 105 comprises a metering facility 111 with a first storage container 107, a second storage container 109, a first substance line 117, a second substance line 119, a first dispenser element 121, a first dispenser line 123, a second dispenser element 125, a second dispenser line 127 and a pump facility 112 with a first pump head 113 and a second pump head 115. The first pump head 113 and the second pump head 115 are connected hydraulically in a parallel manner in the pump facility 112. The metering system 105 comprises a common drive 129 according to FIG. 2 and FIG. 3.

The metering facility 111 further comprises a reversing transmission 140, which is connected between the common drive 129 and the second pump head 115, the reversing transmission 140 being configured to perform a drive direction change.

The common drive 129 can drive the pump facility 112 in a first drive direction 137 or in a second drive direction 139, the reversing transmission 140 performing a drive direction change for the second pump head 115.

The first conveying direction corresponds to the first drive direction 137 of the common drive 129. In the first conveying direction the first pump had 113 pumps the first liquid substance from the first storage container 107 through the first substance line 117 and through the first dispenser line 123 to the first dispenser element 121. When the reversing transmission 140 reverses the drive direction, the second pump head 115 takes in air through the second dispenser element 125 in the first drive direction 137 of the common drive 129 or the second pump head 115 runs dry When the common drive 129 is operated in a second drive direction 139, the first pump head 113 takes in air through the first dispenser element 121 in the second drive direction 139 of the common drive 129 or the first pump head 113 runs dry. When the reversing transmission 140 reverses the drive direction, the second pump head 115 pumps the second liquid substance from the second storage container 109 through the second substance line 119 and through the second dispenser line 127 to the second dispenser element 125 in the second conveying direction.

Figure 5:
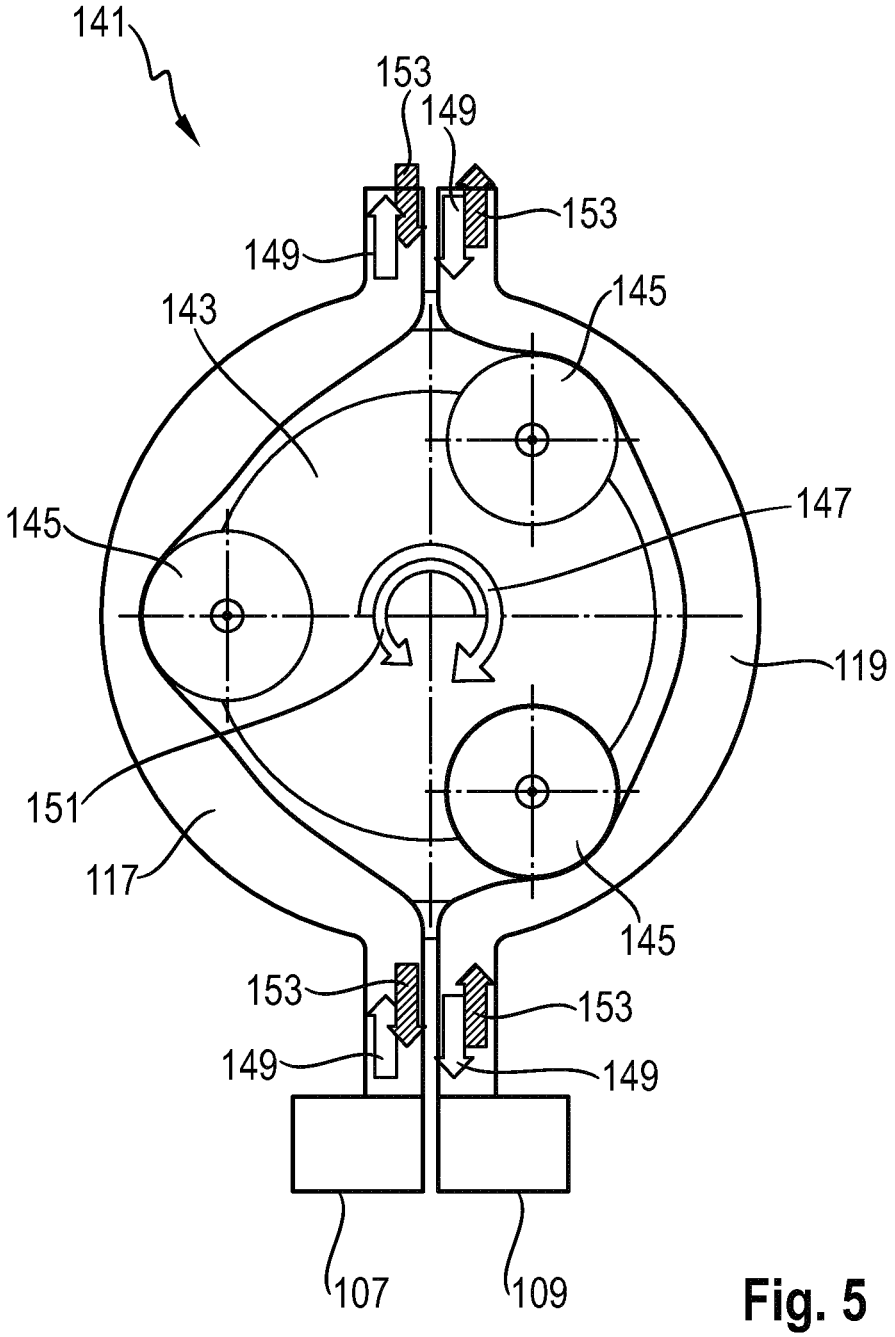
FIG. 5 shows a schematic diagram of a hose pump.

FIG. 5 shows a schematic diagram of a hose pump. The first and second pump heads 113, 115 are combined in one part in the hose pump 141. The hose pump 141 comprises a rotor 143 with three pressure rollers 145, at least one pressure roller 145 being in contact with the first substance line 117 and at least one pressure roller 145 being in contact with the second substance line 119.

Rotating the rotor 143 in a first rotation direction 147 causes liquid substance or fluid to be pumped from the first storage container 107 through the first substance line 117 in a first conveying direction 149. At the same time air from the surroundings of the laundry care appliance 100 is taken in through the second substance line 119 in the first conveying direction and fed to the second storage container 109.

Rotating the rotor 143 in a second rotation direction 151 causes air from the surroundings of the laundry care appliance 100 to be taken in through the first substance line 117 and fed to the first storage container 107 in the second conveying direction 153. At the same time liquid substance or fluid is pumped from the second storage container 109 through the second substance line 119 in the second conveying direction 153.

Alternatively a hose pump 141 can also comprise a first hose pump unit, which is in contact solely with the first substance line 117, and a further hose pump unit, which is in contact solely with the second substance line 119, the first and second hose pump units being arranged one above the other. Using a hose pump 141 with one hose pump unit rather than a hose pump 141 with two hose pump units allows the advantage of greater compactness to be achieved.

As an alternative to a hose pump 141, pumps can be used which require as few moving parts as possible, are compact in structure and can be integrated advantageously in the metering system 105, for example a rotary piston pump, such as a gear wheel pump, an eccentric screw pump, a scroll compressor or rotary vane pump, or a diagonal flow pump or a hose pump 141, and in particular an eccentric screw pump.

Figure 6:
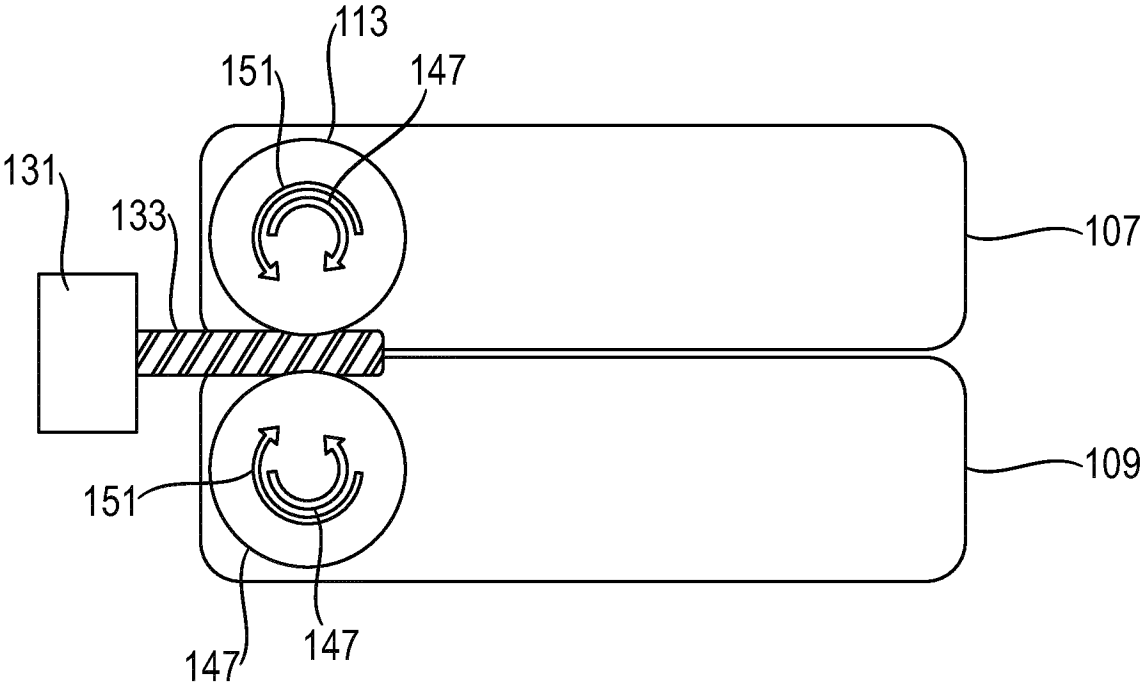
FIG. 6 shows a schematic diagram of a worm shaft in contact with a first and second pump head.

FIG. 6 shows a schematic diagram of a worm shaft with a first and second pump head. The drive motor 131 drives a drive transmission 133, which is configured as a worm shaft and is in contact with the drive wheel of the first pump head 113 and with the drive wheel of the second pump head 115. The first storage container 107 and the second storage container 109 of the metering system 105 are shown in FIG. 5. The drive motor 131 and drive transmission 133, in particular the worm shaft, are configured to drive the first pump head 113 and the second pump head 115 in a first rotation direction 147. By changing the drive direction 137, 139 of the drive transmission 133, in particular the worm shaft, it is possible to drive the first pump head 113 and the second pump head 115 in a second rotation direction 151.

When identical pump heads 113, 115 are used, the first and second pump heads 113, 115 operate counter to one another, while when different pump heads 113, 115 are used, for example pump heads 113, 115 shaped as mirror images of one another, synchronous pump facilities 112 with different conveying directions are possible. Activation of the first and second pump heads 113, 115 by a worm shaft is thus advantageous.

The invention allows a simple, economical and space-saving solution for a metering system 105 for two liquid substances with the option of selecting one of the storage containers 107, 109 by selecting the rotation direction of the drive motor 131. The use of two independent pump heads 113, 115 means there is no cross-contamination of the liquid substances in the storage containers 107, 109. Only one drive motor 131 with one drive transmission 133 is required.

All the features described and illustrated in conjunction with individual embodiments of the invention can be provided in different combinations in the inventive subject matter, in order to achieve their advantageous effects at the same time.

The scope of protection of the present invention is defined by the claims and is not restricted by the features described in the description or illustrated in the drawings.

LIST OF REFERENCE CHARACTERS

100 Laundry care appliance
101 Shaft
103 Door
105 Metering system
107 First storage container
109 Second storage container
111 Metering facility
112 Pump facility
113 First pump head
115 Second pump head
117 First substance line
119 Second substance line
121 First dispenser element
123 First dispenser line
125 Second dispenser element
127 Second dispenser line
129 Common drive
131 Drive motor
133 Drive transmission
135 Coupling element
137 First drive direction
139 Second drive direction

140 Reversing transmission
141 Hose pump
143 Rotor
145 Pressure roller
147 First rotation direction of pump
149 First conveying direction
151 Second rotation direction of pump
153 Second conveying direction

The invention claimed is:

1. A laundry care appliance with a metering system for metering a first liquid substance and a second liquid substance, wherein the metering system comprises a first storage container for supplying the first liquid substance, a second storage container for supplying the second liquid substance, and a pump facility with a first pump head and a second pump head, wherein the metering system comprises a common drive for driving the first pump head and the second pump head, wherein the common drive is able to be driven in a first drive direction and a second drive direction, the first pump head is configured in the first drive direction of the common drive to convey the first liquid substance from the first storage container in a first conveying direction and the second pump head is configured in the second drive direction of the common drive to convey the second liquid substance from the second storage container in a second conveying direction, wherein the first pump head is reversible and the second pump head is reversible, and wherein the first pump head and the second pump head are connected hydraulically in an antiparallel manner.

2. The laundry care appliance as claimed in claim 1, wherein the first conveying direction corresponds to the first drive direction and the second conveying direction corresponds to the second drive direction.

3. The laundry care appliance as claimed in claim 1, wherein the first pump head and the second pump head are connected hydraulically in a parallel manner and the metering system comprises a reversing transmission for a drive direction change, which is connected between the common drive and the second pump head, so that the first pump head can be operated in the first conveying direction in the first drive direction of the common drive and the second pump head can be operated in the second conveying direction in the second drive direction of the common drive.

4. The laundry care appliance as claimed in claim 1, wherein the common drive comprises a drive motor, wherein the drive motor is configured to drive the first pump head and the second pump head and the drive motor in particular comprises an electric motor.

5. The laundry care appliance as claimed in claim 4, wherein the common drive comprises a drive transmission, wherein the drive transmission is configured to transmit a torque of the drive motor, and the metering system comprises a coupling element, wherein the coupling element is configured to couple the drive transmission mechanically to the first pump head and the second pump head.

6. The laundry care appliance as claimed in claim 5, wherein the drive transmission comprises a worm shaft.

7. The laundry care appliance as claimed in claim 1, wherein the first pump head is configured to pump the first liquid substance with a first volumetric flow rate, the second pump head is configured to pump the second liquid substance with a second volumetric flow rate, wherein the first or second volumetric flow rate is a function of viscosity and the first volumetric flow rate and the second volumetric flow rate is greater than the volumetric flow rate when pumping air.

8. The laundry care appliance as claimed in claim 7, wherein the pump facility comprises a non-return valve or float valve to reduce a return flow of liquid from the first storage container or second storage container.

9. The laundry care appliance as claimed in claim 1, wherein the metering system comprises a first dispenser element for dispensing the first liquid substance to the laundry care appliance from the first storage container and the metering system comprises a second dispenser element for dispensing the second liquid substance to the laundry care appliance from the second storage container, wherein the first dispenser element is arranged above the first storage container and the second dispenser element is arranged above the second storage container.

10. The laundry care appliance as claimed in claim 1, wherein the first pump head and the second pump head comprise a rotary piston pump, for example a gear wheel pump, an eccentric screw pump, a scroll compressor or rotary vane pump, or a diagonal flow pump or a hose pump, and in particular an eccentric screw pump.

11. The laundry care appliance as claimed in claim 10, wherein the first pump head or the second pump head is configured respectively as an eccentric screw pump and the respective eccentric screw pump comprises a rotor element and a stator, wherein the rotor element is supported so that it can rotate in the stator.

12. The laundry care appliance as claimed in claim 1, wherein the first pump head or the second pump head is configured respectively as a submersible pump.

13. The laundry care appliance as claimed in claim 1, wherein the first pump head is connected to the first storage container by a first substance line, the second pump head is connected to the second storage container by a second substance line, the first and second pump heads form a hose pump, wherein the hose pump comprises a rotor with at least two pressure rollers, wherein at least one pressure roller is in contact with the first substance line and at least one pressure roller is in contact with the second substance line.

14. The laundry care appliance as claimed in claim 1, wherein the laundry care appliance comprises at least one fill level sensor for detecting a fill level of the first liquid substance in the first storage container and for detecting a fill level of the second liquid substance in the second storage container.

15. The laundry care appliance as claimed in claim 1, wherein the laundry care appliance comprises a shaft with a detergent tray and the metering system comprises a metering facility, wherein the detergent tray is configured to hold the metering facility.

16. The laundry care appliance as claimed in claim 1, wherein when the pump facility is driven in the first drive direction, the first pump head is configured to operate with suction on the first storage container, while the second pump head does not operate with suction on the second storage container in the first drive direction.

17. The laundry care appliance as claimed in claim 1, wherein the first and second pump heads run counter to one another in the first and second drive directions.

18. The laundry care appliance as claimed in claim 1, further comprising a tray positioned on a front surface of the laundry care appliance, the metering system being supported by the tray.

* * * * *